United States Patent [19]

Harris et al.

[11] Patent Number: 4,560,281

[45] Date of Patent: Dec. 24, 1985

[54] FOUNDRY APPARATUS FOR MIXING SAND WITH BINDER

[75] Inventors: David L. Harris, Oregon City; Colin Taylor, Lake Oswego, both of Oreg.

[73] Assignee: Foundry Automation, Inc., Clackamas, Oreg.

[21] Appl. No.: 600,425

[22] Filed: Apr. 16, 1984

[51] Int. Cl.[4] ..... B28C 1/16; B28C 5/14

[52] U.S. Cl. ..... 366/15; 366/27; 366/66; 366/299; 366/300

[58] Field of Search ..... 366/17, 20, 27, 24, 366/35, 38, 28, 52, 50, 33, 65, 66, 64, 131, 139, 10–15, 184–189, 191–193, 163, 181, 194–196, 325, 329, 156, 310, 292, 297–301

[56] References Cited

U.S. PATENT DOCUMENTS

| | | | |
|---|---|---|---|
| 2,365,897 | 12/1944 | Morgan | 366/300 X |
| 3,901,482 | 8/1975 | Kieffaber | 366/330 X |
| 4,037,826 | 7/1977 | Huslander et al. | 366/156 |
| 4,223,996 | 9/1980 | Mathis et al. | 366/27 |
| 4,231,664 | 11/1980 | Flock et al. | 366/66 X |
| 4,281,934 | 8/1981 | Krause et al. | 366/300 X |
| 4,449,826 | 5/1984 | Mathis et al. | 366/66 X |

*Primary Examiner*—Timothy F. Simone

*Attorney, Agent, or Firm*—Kolisch, Hartwell & Dickinson

[57] ABSTRACT

Foundry apparatus for mixing sand with binder ingredients to produce a composite mixture suitable for foundry molds includes a first premixing chamber enclosing a first bladed shaft mounted for rotation about a substantially horizontal first axis operable for conveying and commingling sand with a first binder ingredient to produce a first sand/binder ingredient mixture. A second premixing chamber, separate from the first premixing chamber, encloses a second bladed shaft mounted for counterrotation about a second axis, substantially parallel to the first axis, for conveying and commingling sand with a second binder ingredient to produce a second sand/binder ingredient mixture. A final mixing chamber includes agitators for receiving the sand/binder ingredient mixtures and blending them into a composite mixture while simultaneously transporting the composite mixture to a final discharge station. A single power-driven unit operates for driving the first and second bladed shafts, which in turn, operate the first and second agitators.

25 Claims, 8 Drawing Figures

A
66
79
80
74
104
94
100
102
96
68
92
82
68a
20
62
10
16
24
28
60
14
14a
32
36
34
38
56
50
46
42
12
40
67
67a
67b
67c
P
90°

FIG. 2
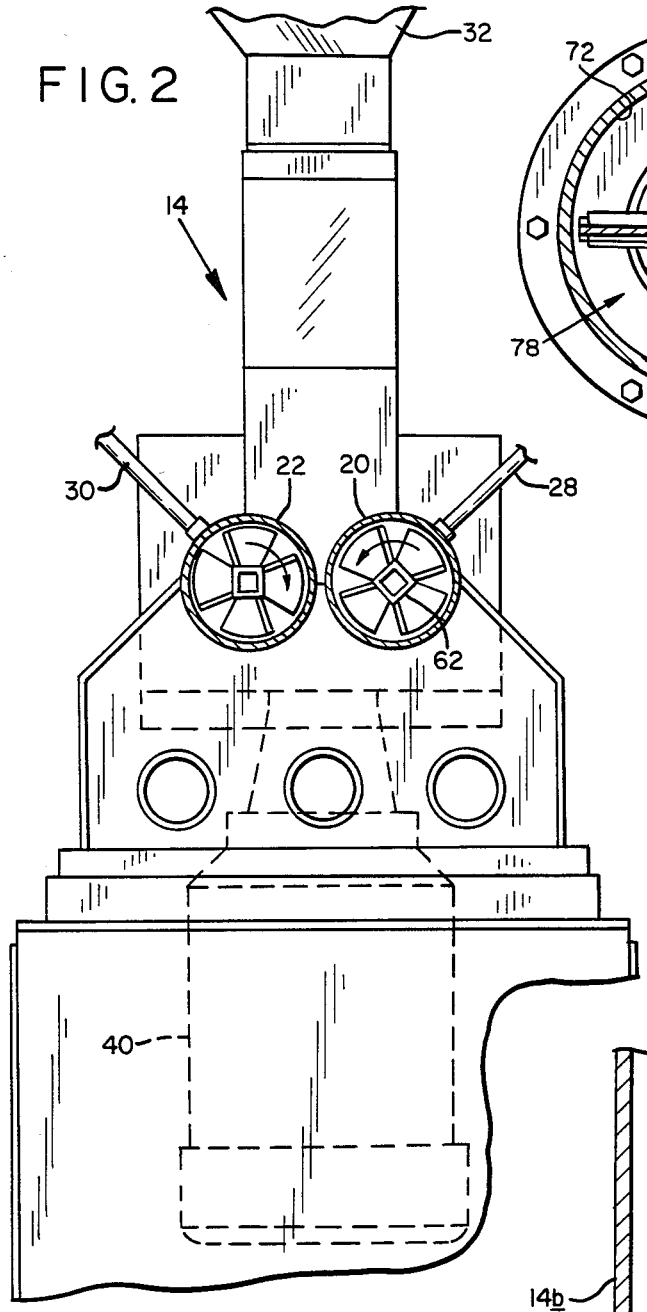
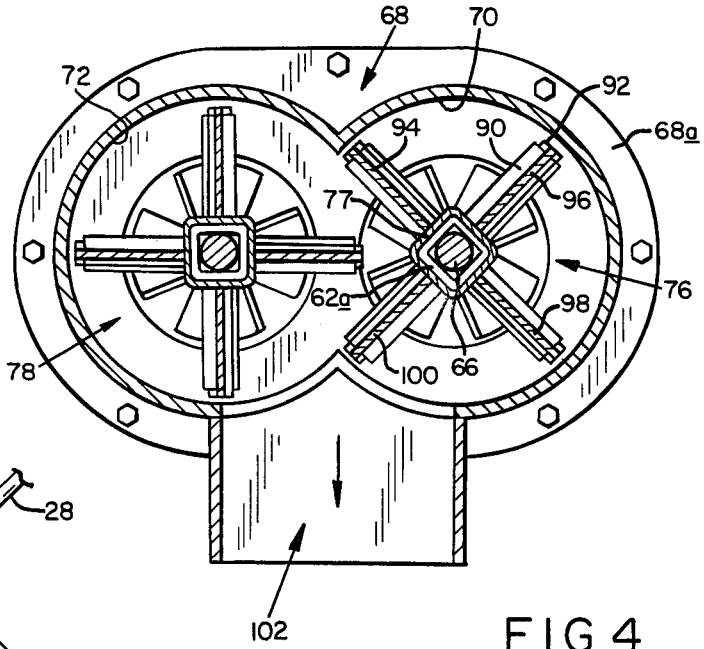
FIG. 4
FIG. 3
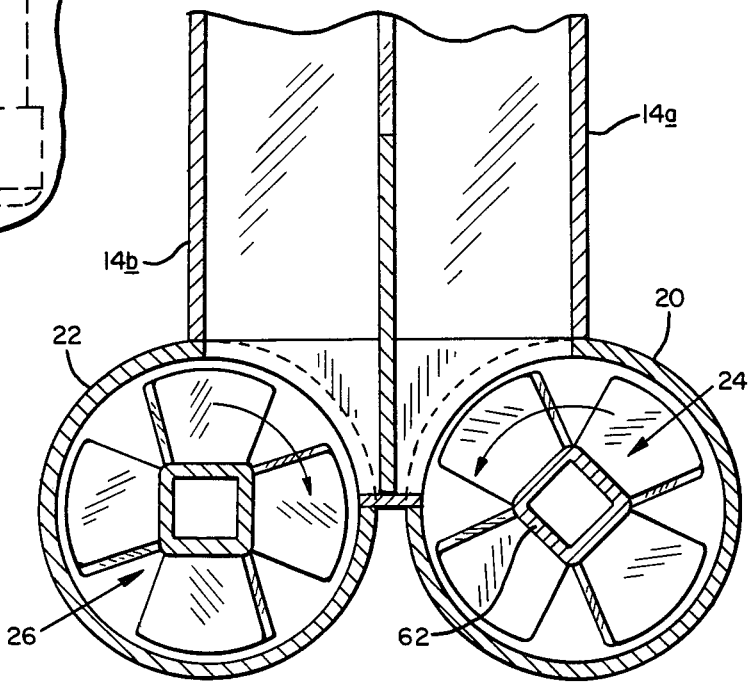

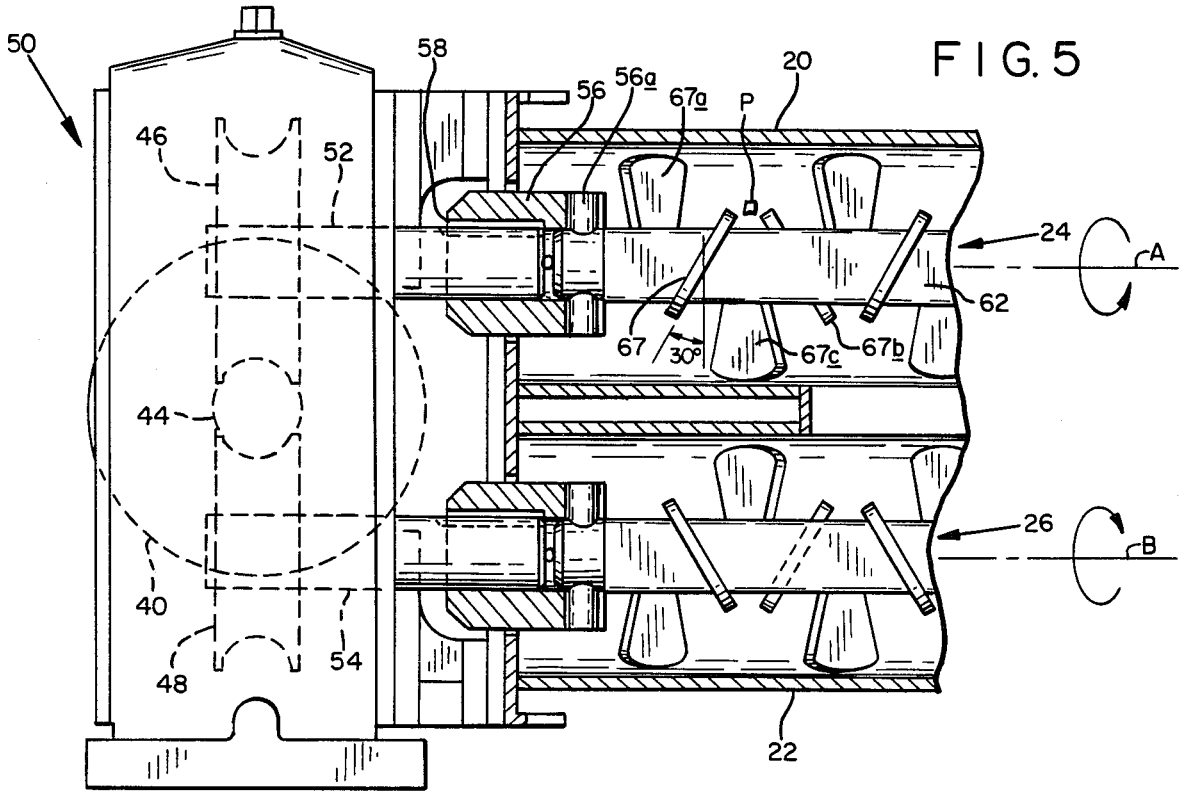
FIG. 5
FIG. 6
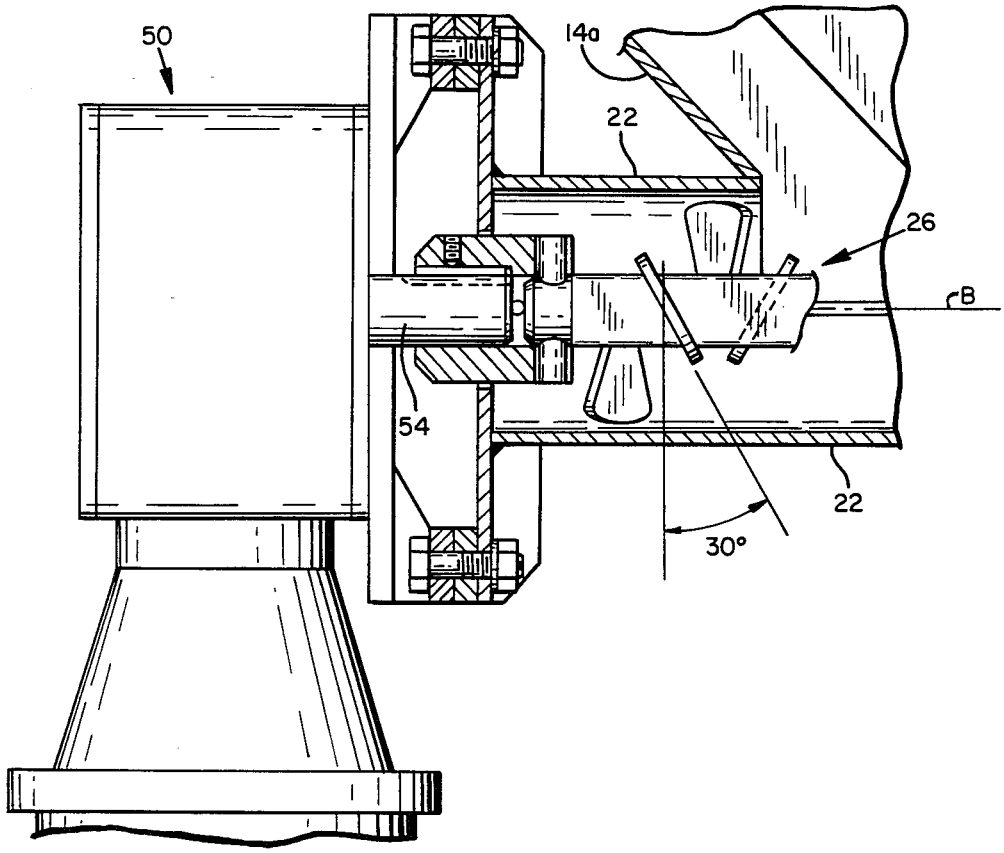

FOUNDRY APPARATUS FOR MIXING SAND WITH BINDER

BACKGROUND AND SUMMARY OF THE INVENTION

The present invention relates to machinery used in foundry processes, and more particularly to a novel foundry apparatus operable for mixing sand with binder ingredients, such as resin and catalyst, in order to produce a composite mixture suitable for foundry molds.

In the art of mixing sand with binder ingredients, it is known to mix sand with resin in one premixing chamber while simultaneously mixing sand with catalyst in another premixing chamber, with the resultant mixtures being brought together for blending in a vertical mixing chamber. Exemplary of that type of apparatus is the construction disclosed in Hulslander et al., U.S. Pat. No. 4,037,826. In that patent, a mixing apparatus is disclosed in which a pair of horizontally positioned premixing chambers are provided with elongate shafts rotatably mounted therewithin which include spiral or helix mixing blades formed as conventional screw-type feeder conveyors.

The premixing chambers transfer, separately, sand mixed with resin and sand mixed with catalyst toward a downstream discharge station. The two mixtures are dispensed downwardly into a vertical mixing chamber which includes a rotator shaft, driven by a motor disposed above the premixing chamber. The vertical mixing chamber includes vertically spaced-apart convoluted blades for mixing the sand introduced from the two premixing chambers. The convoluted mixing blades spiral downwardly and inwardly to mix the material downward through the discharge openings of the mixing chamber.

There are a total of three power sources or motors which are used to drive the mixing apparatus disclosed in the U.S. Pat. No. 4,037,826: one motor for driving the spiral shaft of one of the premixing chambers, another motor for driving the other spiral shaft, and a motor for driving the vertical shaft of the vertical mixing chamber which includes the convoluted mixing blades.

Similarly, Flock et al., U.S. Pat. No. 4,231,664, requires a total of three power sources or motors to operate the mixing apparatus therein disclosed. The U.S. Pat. No. 4,231,664 includes a construction somewhat similar to that of the U.S. Pat. No. 4,037,826, with the exception that the premixing chambers are provided with square shafts having segmented blades formed as a helix for conveying material. However, the U.S. Pat. No. 4,231,664 also discloses the use of a total of three motors for driving the helical shafts as well as the vertical shaft for driving the convoluted blades disposed in the vertically positioned final mixing chamber. The segmented blades are positioned so that when material leaves one trailing edge of a blade, it is subsequently engaged by the leading edge of the next blade positioned 90° away. Thus, material is moved continuously from blade to blade during conveyance along the length of premixing chamber prior to the material being dispensed into the final or vertical mixing chamber.

Another example of an apparatus for making foundry cores is disclosed in Edwards, U.S. Pat. No. 3,580,326, in which parallel and side-by-side positioned feeder-mixer units, including rotatable shafts extending axially therethrough, carry a series of inclined mixing blades. The shafts are driven by a clutch and brake unit operable by a motor which conveys material toward a reaction chamber whereby mixture occurs. The material from the mixer-feeder units is blown into a core box through a blowing head. Obviously, the U.S. Pat. No. 3,580,326 discloses a system in which some type of additional power sources are needed to operate the blowing mechanism.

The above prior art mixing devices contemplate that mixture in the premixing chambers may be effected through a horizontal conveyance of sand and suitable binder material. However, it is disclosed in the above patents that after the mixing of sand with the binder ingredients has occurred, the resultant mixtures must be finally mixed through some type of vertical mixing chamber for dispensing the mixture into a core box or mold. As mentioned above, the various mixing devices which have been discussed contemplate that there are at least several power sources, i.e., it is necessary to drive the auger or bladed shafts of the premixing chambers as well as the shaft of the vertical or final mixing chamber. It is apparent that with multiple power sources, such as motors, downtime for repair and its consequent expense is something which simply cannot be avoided.

Moreover, several of the references, such as the U.S. Pat. Nos. 4,037,826 and 4,231,664, require that the vertical mixing chamber be provided with convoluted blades which are expensive to manufacture. It should also be appreciated that such convoluted blades are difficult to clean, a problem which becomes particularly important to overcome when it is realized that the various binder ingredients which are being mixed together may quickly set up and harden. With convoluted blades there are portions difficult to access for cleaning, and significant downtime may result during cleaning procedures.

The present invention seeks to overcome many of the deficiencies inherent in the prior art mixing apparatus. It is a general object of the present invention to provide a novel apparatus for mixing material, such as particulate matter, with other materials to ensure complete commingling. Specifically, the present invention is directed to a foundry apparatus for mixing sand with binder ingredients to produce a composite mixture suitable for foundry molds or cores which requires the use only of a single power-driven means or motor operable for driving the various components for affecting mixing action. To accomplish this, the present invention utilizes a pair of horizontally-positioned primary mixers, such as first and second premixing means, each of which includes a tubular chamber within which is rotatably driven a bladed shaft operable for conveying and commingling sand with binder ingredients. The premixing means discharge sand with the binder ingredients into a unitary final mixing means which includes a pair of agitator means driven by the bladed shafts of the premixing means. This is accomplished by providing the bladed shafts of each premixing means with extensions which project into the final mixing means. The agitator means are slidably mounted and coupled to the extensions, and thereby rotate therewith.

At a forward end of the final mixing means, there is provided a downwardly extending discharge chute, so that the composite mixture which results from agitation in the final mixing means may be disposed or discharged downwardly into a mold or core box. By aligning the agitator means with the bladed shafts of the premixing means, a single power-driven means or motor may be coupled to the bladed shafts and used to operate the entire apparatus in a mixing sequence.

Another object of the present invention is to provide a pair of premixing means, constructed as above, in which the blades on each shaft are positioned in what may be thought of as a "reverse Archimedes screw." This means that the blade assemblies, which are segmented blades mounted on a square shaft, are positioned in a staggered manner so that they define a reverse helix. This results in what may be thought of as "impulse" mixing during conveyance. Stated differently, it is an object of the present invention to premix sand with binder ingredients so that as the sand and binder ingredients come in contact, they will be mixed together and conveyed forwardly during a rotational sequence of the bladed shaft, but will remain substantially nonconveyed during a subsequent rotational portion and then be conveyed and mixed again.

Still another object of the present invention is to provide a final mixing means, as described above, in which a unitary chamber is provided having semicylindrical sections which communicate with one another. Mounted within each of these semicylindrical sections is an agitator means, coupled to an associated one of the bladed shafts which include paddles sequenced to receive sand and binder ingredient from an associated one of the premixing means and displace that material into contact with sand and binder ingredient material from the other agitator means. Complete commingling of sand and binder ingredient material results in a composite mixture suitable for foundry molds.

Still another object of the present invention is to provide a final mixing means in which a removable end plate may be quickly detached from an end of the unitary chamber to permit access to the agitator means. Moreover, because the agitator means are slidably mounted on an associated extension from the bladed shafts, the agitator means may be quickly removed and cleaned. This becomes particularly important when it is realized that the binder ingredients, emergent with sand from the first and second premixing means, may quickly set up, thus necessitating quick access for disassembly of the components to enable cleaning.

Still another object of the present invention is to provide a base structure for the mixing apparatus in which a drive means, such as a motor, is disposed beneath the horizontally disposed first and second premixing means at a downstream end thereof. A shaft from the motor extends vertically upwardly, and by a suitable worm and gear arrangement is coupled to ends of the bladed shafts operable for rotatably driving each in counterrotation to one another.

These and additional objects and advantages of the present invention will be more readily understood after a consideration of the drawings and the detailed description of the preferred embodiment.

BRIEF DESCRIPTION OF THE DRAWINGS

FIG. 2 is a cross-sectional view taken along lines 2—2 of FIG. 1;

FIG. 3 is a cross-sectional view taken along lines 3—3 of FIG. 1 and illustrates the relationship between sand chutes for delivering the sand into the premixing chambers;

FIG. 4 is a cross-sectional view taken along lines 4—4 of FIG. 1 and illustrates the orientation of agitator means in the final mixing chamber;

FIG. 5 is a top plan view, shown in cross section, of the premixing chambers showing connection of the bladed shafts to the power drive;

FIG. 6 is a side elevation view of one of the bladed shafts illustrating its connection to the drive unit;

DETAILED DESCRIPTION OF THE PREFERRED EMBODIMENT

Broadly speaking, the present invention is directed to an apparatus for conveying and mixing materials, such as particulate material, with other ingredients. As stated at the outset herein, the present invention finds particular application for use as a foundry apparatus for completely mixing sand with various ingredients so as to form a composite mixture suitable for use in foundry molds and cores. Specifically, it is desired to mix sand with a first binder ingredient, such as resin, in a first premixing means while simultaneously mixing sand with a second binder ingredient, such as catalyst, in a second premixing means. These resultant mixtures are then conveyed to a final mixing means, which includes agitator means for blending the resultant sand/resin and sand/catalyst mixtures into a composite mixture.

It is also desired to use only a single power source or motor for driving the entire apparatus, and to accomplish this, the present invention utilizes a pair of auger or bladed shafts which are directly connected to associated agitator means in the final mixing chamber. The agitator means are driven by the bladed shafts about their respective longitudinal axes. Discharge paddles mounted on the agitator means force the composite mixture from the premixing means down through a discharge opening for investment into a mold or core box. The bladed shafts of the present invention are provided with blades which are the "inverse" of an Archimedes screw. The blades are not arranged in a conventional auger flight helical or spiral. These features and others will now be considered in greater detail below.

Figures 1, 7:
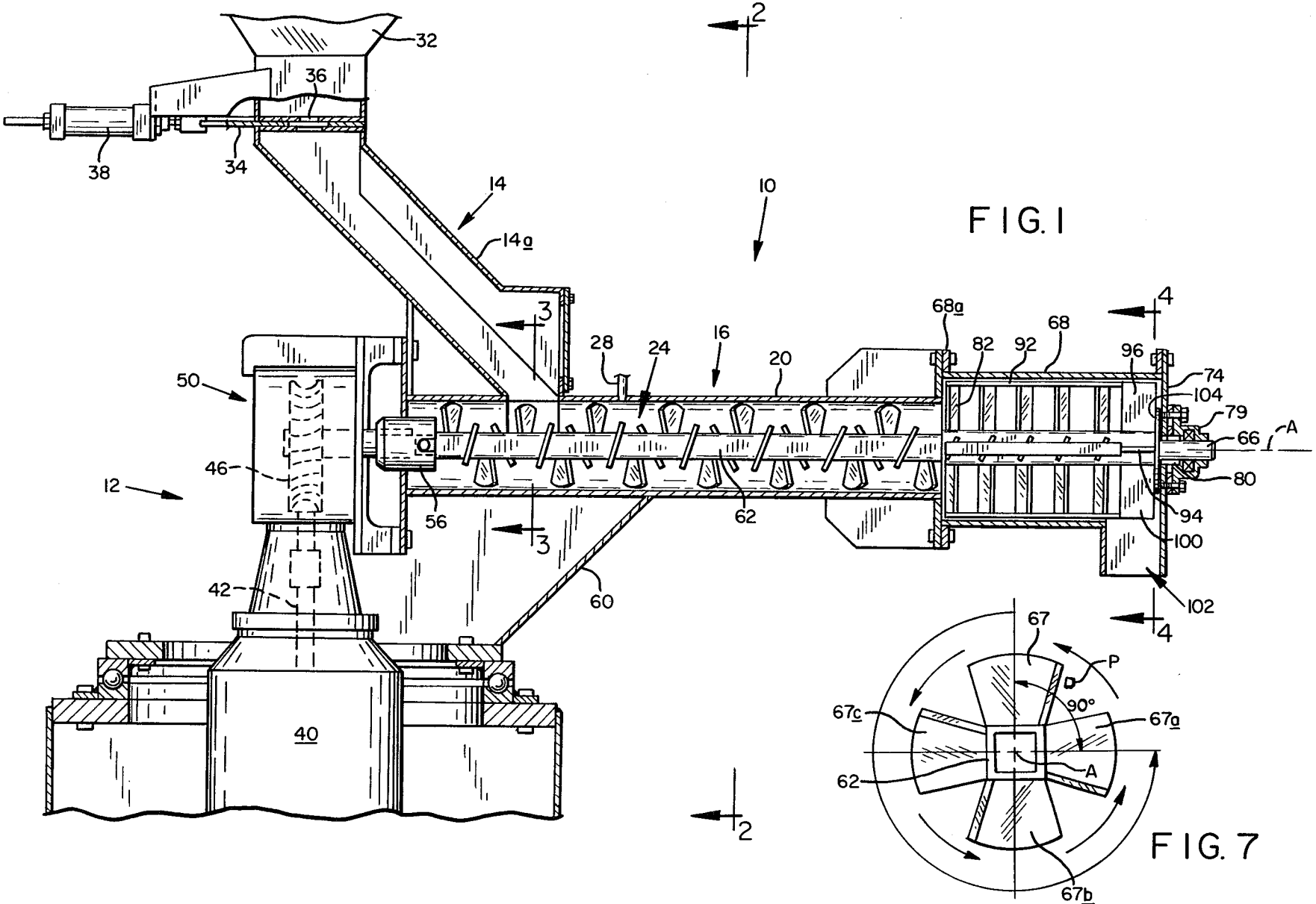
FIG. 1 is a side elevational view, taken in cross section, through one of the premixing chambers and the final mixing chamber of the apparatus of the present invention.
FIG. 7 is a schematic view of one of the blade assemblies of a bladed shaft illustrating movement of a sand particle or mass.

Turning to FIG. 1 of the drawings, a foundry sand mixing apparatus, in accordance with the present invention, is generally indicated at 10. Apparatus 10 is constructed with several main components, such as a power-driven means or drive unit generally indicated at 12, a sand feed means generally indicated at 14, a premixing means generally indicated at 16 and a final mixing means generally indicated at 18. It is to be understood that premixing means 16 includes a pair of separate, tubular chambers, each of which houses a rotatable auger assembly, such as the bladed shafts mentioned above. Final mixing means 18 includes a pair of agitator means for agitating mixtures received within a final mixing chamber and blending these materials for discharge. This entire assembly is driven by a single motor.

As shown in FIG. 2, premixing means 16 is defined by a first premixing means 20 and a second premixing means 22. Inasmuch as the first and second premixing means are generally of the same construction, primary attention will be focused on first premixing means 20

(see FIGS. 1 and 5), which is seen to include a first tubular chamber, of cylindrical construction, within which is mounted a rotatably driven first auger assembly such as first bladed shaft 24. The first bladed shaft is mounted for rotation about a substantially horizontal first axis A, and is operable for conveying and commingling material. Second premixing means 22 is disposed substantially horizontally and parallel to first premixing means 20, and is defined by a second tubular chamber, also of cylindrical construction, within which is mounted a rotatably driven auger assembly such as second bladed shaft, generally indicated at 26. The second bladed shaft rotates about second axis B, which is parallel to first axis A. It is to be understood that each of the bladed shafts is driven in a counterrotation manner relative to the other, as shown in FIGS. 2–5.

For example, as shown in FIGS. 2 and 3, it can be seen that first bladed shaft 24 is rotatably driven counterclockwise, while second bladed shaft 26 is driven clockwise. Each of the tubular chambers of the premixing means is provided with a feeder means for introducing ingredients, such as chemicals, which are to be mixed with sand. For example, as shown in FIG. 2, a first feed means 28 includes a conduit for directing a binder ingredient from a source (not shown) into the first premixing means. A second feed means, indicated at 30, also includes a conduit for introducing a second binder ingredient, such as catalyst, from a source (not shown) into second premixing means 22. The introduction of sand, at an upstream end of each of the premixing means, is accomplished by sand feed means 14.

As shown in FIGS. 1 and 3, sand feed means 14 includes a pair of chutes such as indicated at 14*a*, 14*b*. Each of the chutes extends angularly upwardly from an introduction region adjacent an upstream end of an associated premixing means for connection to a hopper indicated at 32. A sand gate, indicated at 34, is operable for permitting sand to be discharged through an opening 36 into the sand chutes or closing off same. The sand gate is selectively extended or retracted by means of a fluid-powered actuator indicated at 38.

As mentioned previously, the foundry apparatus is actuated by a single power-driven means such as drive unit 12. As shown in FIG. 1, drive unit 12 is mounted in a base structure and is defined by a single motor 40 from which vertically upwardly extends a drive shaft 42. The drive shaft is connected to a worm gear 44 which, in turn, drives a pair of spur gears, such as spur gears 46, 48 shown in FIG. 5. The worm and spur gears are all mounted within a reduction unit or housing generally indicated at 50. As shown in FIG. 5, each of the spur gears is connected to an output shaft. For example, spur gear 46 is connected to output shaft 52 and spur gear 48 is connected to output shaft 54. As mentioned previously, each of the premixing means is substantially similar in construction, and thus only first premixing means 20 and first bladed shaft 24 and coupling to output shaft 52 will be described. As shown in FIG. 5, a coupling 56 is secured by means of a key 58 to output shaft 52. The mounting of the upstream end of first bladed shaft 24 is accomplished by means of a pin connection, i.e., a pin is inserted through a bore 56*a* of coupling 56 and into an aligned bore in the end of the first bladed shaft.

Figure 8:
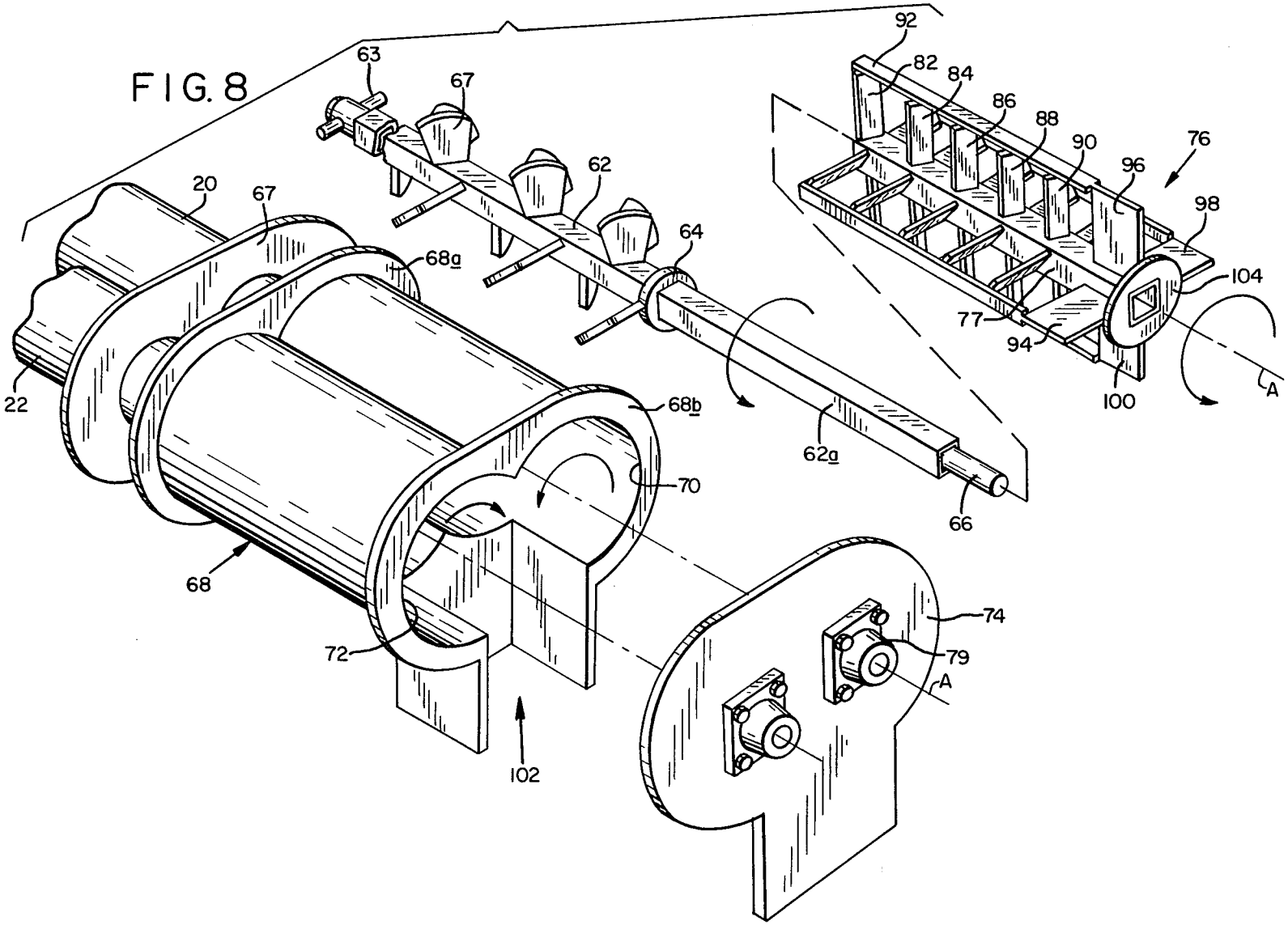
FIG. 8 is an exploded view illustrating the mounting of one of the agitator assemblies onto an extension from one of the bladed shafts.

Turning now to further details of first premixing means 20, it will be seen that the first tubular chamber is secured at its upstream end to housing 50. The chamber is supported via a cantilever 60. As shown in FIGS. 1 and 5 (see also FIG. 8), first bladed shaft 24 is defined by a shaft of orthogonal cross section, preferably a square tubular shaft such as indicated at 62. Shaft 62 is secured to coupling 56 by means of a pin 63, through the coupling-bore arrangement previously described. As shown in FIG. 8, it will be noted that shaft 62 is provided with a ring-like abutment 64 and also includes a non-bladed shaft extension 62*a*. At an end of extension 62*a* there is provided a cylindrical rod 66. The function of these components will be explained later.

As shown in FIG. 5, shaft 62 is provided with a plurality of conveying blades, such as indicated at 67, 67*a*, 67*b*, 67*c*, etc. It will be observed that each of these blades has its longitudinal axis directed at right angles to the longitudinal axis of rotation, such as first axis A. The blades are mounted on the first and second bladed shafts spaced-apart longitudinally therealong and are staggered radially, in the direction of shaft rotation. For example, blades 67, 67*a*, 67*b* and 67*c* are mounted on alternating flat surfaces of shaft 62 and have their longitudinal axes perpendicular to first axis A. Similarly, the blades mounted on second bladed shaft 26 also are mounted perpendicularly to second axis B. It is to be noted that the blades are mounted on shaft 62 so that their planar faces are disposed at an angle generally in the range of 20°–40° (preferably 30°) relative to the rotational axes, such as first axis A.

The 30° orientation is shown with respect to blade 67, but it should be appreciated that each of the blades, secured to alternating planar faces of tubular shaft 62, are oriented in the same manner, however, it should be observed that they are not arranged in what may be thought of as a conventional auger or helical flight orientation. Rather, as shown in FIGS. 5 and 6, the blades are arranged in what may be thought of as a reverse or "inverse" Archimedes screw. The blades are staggered longitudinally along shaft 62 (see FIGS. 5 and 7) so that each is offset radially 90°, in the directon of shaft rotation, from its immediate predecessor. For example, blade 67 is disposed in advance, and offset 90° radially from blade 67*a*, its immediate predecessor. The effect of this construction is to enable complete mixing of sand with the chemical ingredients in a manner which has been found to be superior to conventional helical auger flight constructions.

Specifically, the blades arranged as shown provide what may be thought of as an "impulse" or "stop-go" action to sand particles. This means that a particle or mass of particles is conveyed, settled, and then conveyed again and so on in a continuously repeated manner. Rather than a sand particle or mass merely being continuously pushed, the particle is conveyed, allowed to have other particles "catch-up" with it for further commingling and then conveyed again. Perhaps this concept can be best appreciated from a consideration of FIGS. 5 and 7. A particle P is shown after it has emerged from contact with blade 67, i.e., the particle has left the trailing edge of that blade. The particle or mass will remain relatively nonconveyed, as shown in FIGS. 5 and 7, until tubular shaft 62 has rotated somewhere in the range of 225°–270° whereby particle P will be then picked up by blade 67*c*. During this period, prior to its being picked up by blade 67*c*, the particle will be "settled" and other particles may be conveyed by the blades for engagement therewith during the settling period to effect complete commingling as the material moves downstream. This is to be contrasted with a conventional auger flight or helix construction in which particles to be mixed and conveyed are continuously pushed as a mass, thereby permitting "clumps" or unmixed portions to remain unmixed.

Next, a description of the final mixing means will be set forth. As shown in FIG. 1, final mixing means 18 includes a blending chamber defined by a unitary chamber 68 mounted on the first and second premixing means. As shown in FIGS. 4 and 8, unitary mixing chamber 68 includes a pair of communicating semicylindrical sections 70, 72. The unitary chamber is provided with a flange means 68*a* so that it may be detachably engageable to a corresponding common flange means 67 interconnecting the first and second premixing means. A second flange means 68*b* is provided on the downstream end of unitary chamber 68 and serves as a mounting for a detachably mountable end plate 74 (see also FIG. 1). The unitary chamber houses or encloses a pair of agitator means (see FIG. 4) such as first and second agitator means 76, 78.

As shown in FIG. 8, first agitator means 76 (second agitator means 78 being virtually identical) is formed with a square tubular shaft 77 dimensioned so that it may be slidably received over shaft extension 62*a* of shaft 62 of the first premixing means. FIG. 8 also illustrates that tubular shaft 77 is slidably received over shaft extension 62*a* until an end of tubular shaft 77 engages abutment 64. In that position, which is the assembled position as shown in FIG. 1, rod 66 exits through an opening in end plate 74. Shaft 66 is journaled to end plate 74 by means of a self-centering ball bearing 79 and a thrust collar 80. Thus, it can be appreciated that first bladed shaft 24, disposed in first premixing means 20, and first agitator means 76, disposed in unitary chamber 68, are journaled at coupling 56 and at end plate 74 for rotation about first axis A. The first agitator means is disposed horizontally and is rotatable about an axis concentrically aligned with first axis A. The second agitator means is similarly mounted.

Attention will now be directed to the specific construction of first agitator means 76. As shown in FIG. 8, a plurality of upright extending conveying paddles, such as indicated at 82, 84, 86, 88, 90, are spaced-apart and mounted on one planar face of tubular shaft 77. Similarly, additional conveying paddles are mounted on the remaining three faces of tubular shaft 77, all of the conveying paddles having their longitudinal axes disposed perpendicular to first axis A or the longitudinal axis of tubular shaft 77. The conveying paddles outwardly extend to a position adjacent the interior wall surfaces of the blending chamber. It will be further noted that the planar faces of each of the conveying paddles is oriented at a 30° angle, approximately, relative to the longitudinal or first axis A.

Secured to the distal ends of each of the conveying paddles is an elongate wiper means 92. As shown in FIG. 4, the wiper means, such as wiper means 92, are arranged for positioning, during rotation, adjacent the interior wall surfaces of each of the semicylindrical sections, such as section 70. The wiper means facilitate removal, by scraping action, of material which may become adhered to the interior surfaces of the semicylindrical section. Also, as best illustrated in FIG. 8, it will be noted that a distal end of tubular shaft 77 is provided with four discharge paddles, such as indicated at 94, 96, 98 and 100 (see also FIG. 4). The discharge paddles are arranged for receiving material from the conveying paddles and forcing that material, which is a composite mixture, vertically downwardly through a discharge opening indicated at 102 in unitary chamber 68. Similarly, discharge paddles are arranged on the other agitator means, and as shown in FIG. 4, are arranged relative to one another so as to overlap directly over discharge opening 102 to force material downwardly therethrough. A sealing disk is illustrated at 104.

Operation

With the above description of the structural components having been presented, a description of the operation of mixing apparatus 10 of the present inventon will now be set forth. Initially, sand gate 34 is disposed in the closed position so that no sand will emerge from hopper 32 for downward flow through sand feed means 14. Motor 40 is started, and rotation of input shaft 42 rotates worm gear 44 and the associated spur gears 46, 48. The bladed shafts of the premixing means, such as first bladed shaft 24 of first premixing means 20, are correspondingly rotated. Because shaft extension 62*a* is interconnected (see FIG. 8) to the first agitator means, rotation is imparted thereto about the associated rotational axes, such as first axis A. With the first premixing means and the agitator means in operation, sand gate 34 is opened so that sand is dispensed through chutes 14*a*, 14*b* into the tubular chambers of the premixing means. At the same time, in predetermined metered amounts, binder ingredients are introduced into first premixing means 20 via first feed means 28 and into second premixing means 22 via second feed means 30.

The first premixing means, with its bladed shaft, operates for conveying and commingling sand with a first binder ingredient, such as resin, to produce a first sand/binder ingredient mixture which exits through a downstream end of the tubular chamber into semicylindrical section 70 of unitary chamber 68. Similarly, second bladed shaft 26, counterrotatably driven about second axis B, conveys and commingles sand with a second binder ingredient, such as a catalyst, to produce a second sand/binder ingredient mixture which is introduced into semicylindrical section 72 of unitary chamber 68. When the sand/binder ingredient mixtures emerge into unitary chamber 68, they are picked up by the first and second agitator means, respectively, and intermixed and commingled further by action of the conveying paddles of the agitator means. Because semicylindrical sections 70, 72 communicate with one another (see FIG. 4), it should be appreciated that complete blending of the first and second sand/binder ingredient mixtures from the premixing means into a composite mixture occurs, with that mixture being simultaneously transported toward discharge opening 102. As the composite mixture approaches the discharge opening, the discharge paddles, such as paddles 94, 96, 98, 100 on first agitator means 76 mesh with corresponding discharge paddles on the second agitator means to force the composite mixture downwardly in a substantially vertical direction through discharge opening 102 and into a preplaced container for creating a foundry mold. It should be appreciated that the final mixing means, which includes unitary chamber 68 and the associated agitator means, provides for complete blending of the materials emerging from the first and second premixing means, and also ensures that a minimal amount of material will remain adhered to the walls of the unitary chamber.

From the above discussion, it should be apparent that there are several very important advantages which result from the construction and operation of the present foundry apparatus for mixing sand with chemical binder ingredients. First of all, significant savings in power and equipment for operating the apparatus are achieved by aligning the final mixing means with the premixing means. The prior art foundry mixing apparatus utilize a vertical final mixing chamber which, as mentioned before, requires the addition of another drive motor. However, with the horizontal arrangement described above, whereby the premixing and final mixing chambers include components driven about concentric, horizontally positioned rotational axes, a single motor, with appropriate transmission means, may be employed to operate the entire apparatus. It should be apparent that substantial savings in power, equipment, etc. necessarily result.

In addition, by placing the final mixing means in alignment with the premixing means, detachment of components for cleaning or repair may be readily made. For example, referring to FIGS. 1 and 8, it can be seen that removal of end plate 74 permits ingress to the interior of unitary chamber 68. The chamber and paddles, etc. may thereby be cleaned, or repairs made. In addition, it is a relatively simple matter to remove unitary chamber 68 from its connection with the premixing means because of the flanged construction as illustrated. If required, tubular shaft 77 may be slidably removed from shaft extension 62*a* of the first premixing means for repair, etc. Similarly, the second premixing and agitator means may be disassembled.

Another advantage resulting from the aligned arrangement of the premixing-final mixing means is that a wide range of different sized mold or core boxes may be placed beneath discharge opening 102 for receiving the composite mixture. In typical sand mixers, the composite mixture is formed in a vertical mixing arrangement which requires that the mixing apparatus as a whole be placed relatively high so that a range of mold boxes may be slipped therebeneath. With the construction of the present invention, there is virtually no vertical limitation over the normal range of mold box heights. Moreover, because a single motor is utilized, driven from beneath, the rear of the apparatus may be positioned adjacent a wall, thereby providing further space savings in a production facility, if needed. The unit as a whole is freestanding, very compact and efficient, with cantilever 60 bearing the load of the premixing and final mixing chambers.

Another significant advantage of the present invention resides in the "inverse" blade construction of the first and second premixing means bladed shafts. The arrangement permits particles or groups of particles to be completely commingled, inasmuch as a stop-go action or "impulse" effect is achieved.

While the present invention has been shown and described with reference to the foregoing preferred embodiment, it will be appreciated by those skilled in the art that other changes in form and detail may be made therein without departing from the spirit and scope of the invention as defined in the appended claims.

It is claimed and desired to secure by Letters Patent:

1. Foundry apparatus for mixing sand with binder ingredients to produce a composite mixture suitable for foundry molds comprising:

first premixing means defined by a first tubular chamber enclosing a first bladed shaft mounted for rotation about a substantially horizontal first axis operable for conveying and commingling sand with a first binder ingredient to produce a first sand/binder ingredient mixture;

second premixing means defined by a second tubular chamber disposed adjacent and separate from the first premixing means enclosing a second bladed shaft mounted for counterrotation about a second axis, substantially parallel to the first axis, for conveying and commingling sand with a second binder ingredient to produce a second sand/binder ingredient mixture;

final mixing means defined by a blending chamber enclosing a first agitator means rotatably driven by the first bladed shaft and a second agitator means rotatably driven by the second bladed shaft operable for receiving and blending the first and second sand/binder ingredient mixtures into a composite mixture while simultaneously transporting the composite mixture to a final discharge station, the first agitator means being rotatable about a longitudinal axis aligned with the first axis and the second agitator means being rotatable about a longitudinal axis aligned with the second axis; and single power-driven means operable for driving the first and second bladed shafts.

2. The foundry apparatus of claim 1 wherein the blending chamber is defined by a unitary chamber mounted on the first and second premixing means defining a volume having a pair of communicating semicylindrical sections which enclose the first and second agitator means.

3. The foundry apparatus of claim 2 wherein each first and second bladed shaft includes a nonbladed shaft extension dimensioned to project into the blending chamber for providing a mount for the first and second agitator means, respectively.

4. The foundry apparatus of claim 3 wherein the first and second agitator means each include a hollow shaft from which conveying paddles outwardly extend to a position adjacent the interior wall surfaces of the blending chamber, the hollow shafts being dimensioned for slidable reception upon an associated one of the shaft extensions.

5. The foundry apparatus of claim 4 wherein the conveying paddles are provided with wiper means at their distal ends for facilitating removal of material adhered to the interior wall surfaces of the blending chamber.

6. The foundry apparatus of claim 5 wherein the blending chamber includes a discharge opening disposed for directing the composite mixture downwardly in a substantially vertical direction, and wherein the first and second agitator means include discharge paddles disposed above the discharge opening for forcing the composite mixture vertically downwardly therethrough during rotation of the first and second bladed shafts.

7. The foundry apparatus of claim 6 wherein the discharge paddles are dimensioned lengthwise for enabling opposed ones on the first and second agitator means to overlap, above the discharge opening during rotation of the first and second bladed shafts, to force the composite mixture vertically downwardly therethrough.

8. The foundry apparatus of claim 7 wherein the first and second tubular chambers are connected by a common flange means at a discharge end thereof, and wherein the blending chamber includes a corresponding flange means detachably engageable with the flange means of the first and second tubular chambers.

9. The foundry apparatus of claim 8 further including an end plate detachably mountable on the end of the blending chamber for enclosing same and providing bearing mounts for the shaft extensions.

10. The foundry apparatus of claim 9 wherein the shaft extensions and the hollow shafts of the first and second agitator means are orthogonal in cross section.

11. The foundry apparatus of claim 2 wherein the power-driven means is disposed beneath the first and second premixing means, and includes a drive shaft coupled to a transmission means coupled to the first and second bladed shafts.

12. The foundry apparatus of claim 11 wherein the transmission means is defined by gear means connected to the first and second bladed shafts and coupling means provided on the drive shaft.

13. The foundry apparatus of claim 12 wherein the power-driven means is mounted in a base structure which supports the first and second premixing means and the final mixing means.

14. The foundry apparatus of claim 2 wherein a plurality of blades are mounted on the first and second bladed shafts, each blade being spaced-apart longitudinally therealong and staggered radially, in the direction of shaft rotation, from its immediate predecessor blade.

15. The foundry apparatus of claim 14 wherein the first and second bladed shafts are orthogonal in cross section, with the blades being mounted on the planar faces of each of the first and second bladed shafts, staggered radially generally 90° from one another.

16. The foundry apparatus of claim 15 wherein each of the blades includes planar faces, disposed at an angle in the range of 20°–40° relative to the longitudinal axis of each bladed shaft.

17. Apparatus for mixing and conveying materials comprising:

first premixing means defined by a first tubular chamber enclosing a first bladed shaft mounted for rotation about a substantially horizontal first axis operable for conveying and commingling particulate material with a first ingredient to produce a first particulate material/ingredient mixture;

second premixing means defined by a second tubular chamber disposed adjacent and separate from the first premixing means enclosing a second bladed shaft mounted for counterrotation about a second axis, substantially parallel to the first axis, for conveying and commingling particulate material with a second ingredient to produce a second particulate material/ingredient mixture;

final mixing means defined by a blending chamber enclosing a first agitator means rotatably driven by the first bladed shaft and a second agitator means rotatably driven by the second bladed shaft operable for receiving and blending the first and second particulate material/ingredient mixtures into a composite mixture while simultaneously transporting the composite mixture to a final discharge station, the first agitator means being rotatable about a longitudinal axis aligned with the first axis and the second agitator means being rotatable about a longitudinal axis aligned with the second axis; and single power-driven means operable for driving the first and second bladed shafts.

18. The apparatus of claim 17 wherein the blending chamber is defined by a unitary chamber mounted on the first and second premixing means defining a volume having a a pair of communicating semicylindrical sections which enclose the first and second agitator means.

19. The apparatus of claim 18 wherein each first and second bladed shaft includes a nonbladed shaft extension dimensioned to project into the blending chamber for providing a mount for the first and second agitator means, respectively.

20. The apparatus of claim 19 wherein the first and second agitator means each include a hollow shaft from which conveying paddles outwardly extend to a position adjacent the interior wall surfaces of the blending chamber, the hollow shafts being dimensioned for slidable reception upon an associated one of the shaft extensions.

21. The apparatus of claim 20 wherein the conveying paddles are provided with wiper means at their distal ends for facilitating removal of material adhered to the interior wall surfaces of the blending chamber.

22. The apparatus of claim 21 wherein the blending chamber includes a discharge opening disposed for directing the composite mixture downwardly in a substantially vertical direction, and wherein the first and second agitator means include discharge paddles disposed above the discharge opening for forcing the composite mixture vertically downwardly therethrough during rotation of the first and second bladed shafts.

23. The apparatus of claim 22 wherein the discharge paddles are dimensioned lengthwise for enabling opposed ones on the first and second agitator means to overlap, above the discharge opening during rotation of the first and second bladed shafts, to force the composite mixture vertically downwardly therethrough.

24. The apparatus of claim 23 wherein the first and second tubular chambers are connected by a common flange means at a discharge end thereof, and wherein the blending chamber includes a corresponding flange means detachably engageable with the flange means of the first and second tubular chambers.

25. The apparatus of claim 24 further including an end plate detachably mountable on the end of the blending chamber for enclosing same and providing bearing mounts for the shaft extensions.

* * * * *